United States Patent [19]

Hibino

[11] Patent Number: 4,878,472

[45] Date of Patent: Nov. 7, 1989

[54] AIR-FUEL RATIO FEEDBACK CONTROL METHOD FOR INTERNAL COMBUSTION ENGINES

[75] Inventor: Yoshitaka Hibino, Wako, Japan

[73] Assignee: Honda Giken Kogyo K.K., Tokyo, Japan

[21] Appl. No.: 228,545

[22] Filed: Aug. 4, 1988

[30] Foreign Application Priority Data

Aug. 31, 1987 [JP] Japan ..... 62-217252

[51] Int. Cl.[4] ..... F02M 17/00

[52] U.S. Cl. ..... 123/489; 123/440

[58] Field of Search ..... 123/484, 440, 438, 480

[56] References Cited

U.S. PATENT DOCUMENTS

| | | | |
|---|---|---|---|
| 4,534,330 | 8/1985 | Osuga et al. | 123/440 |
| 4,651,695 | 3/1987 | Ohtaki et al. | 123/440 |
| 4,759,328 | 7/1988 | Blüanel et al. | 123/489 |
| 4,763,629 | 8/1988 | Okazaki et al. | 123/440 |

*Primary Examiner*—Raymond A. Nelli

*Attorney, Agent, or Firm*—Arthur L. Lessler

[57] ABSTRACT

A method of controlling the air-fuel ratio of a mixture being supplied to an internal combustion engine, in a feedback manner responsive to an output signal from an $O_2$ sensor arranged in the engine exhaust system for sensing the concentration of a component in exhaust gases from the engine to produce as the output signal a normally fluctuating output signal indicative of the concentration. The air-fuel ratio is controlled to a desired value by means of at least one of proportional control applying a first correction value to correct the air-fuel ratio when the output signal changes from a rich side to a lean side or vice versa with respect to a predetermined reference value, and integral control applying a second correction value to correct the air-fuel ratio whenever a predetermined period of time elapses so long as the output signal remains on the lean side or on the rich side with respect to the predetermined reference value. A correcting amount is determined in response to the rate of change in the output signal of the $O_2$ sensor. The second correction value is to be increased or decreased by means of the correcting amount, depending upon whether the output signal remaining on the lean side or on the rich side.

10 Claims, 10 Drawing Sheets

| FIG. 7A |
| --- |
| FIG. 7B |

AIR-FUEL RATIO FEEDBACK CONTROL METHOD FOR INTERNAL COMBUSTION ENGINES

BACKGROUND OF THE INVENTION

This invention relates to a method of controlling the air-fuel ratio of a mixture being supplied to internal combustion engines, and more particularly to such a control method, which is able to compensate for variations in the output characteristic of an exhaust gas component concentration sensor arranged in the exhaust system of the engine, due to tolerances in the manufacture thereof, and aging change in the output characteristic of same.

An air-fuel ratio feedback control method is generally employed which comprises comparing a value of exhaust gas component (e.g. oxygen) concentration sensed by an exhaust gas component concentration sensor (e.g. and $O_2$ sensor) arranged in the exhaust system of the engine, with a predetermined reference value, to thereby control the air-fuel ratio of a mixture supplied to the engine to a stoichiometric mixture ratio at which the best conversion efficiency of a three-way catalyst arranged in the exhaust system is obtained, thereby enhanced the emission characteristics, etc. of the engine.

However, it is known that $O_2$ sensors used in general for the air-fuel feedback control suffer from variations in the output characteristics due to tolerances in the manufacture thereof, and also from aging changes in the output characteristics.

If the air-fuel ratio feedback control is actually effected by using an $O_2$ sensor having an output characteristic that the output voltage is apt to be biased toward a rich side, the resulting air-fuel ratio is controlled to a leaner value than the stoichiometric mixture ration, whereas if the control is effected by using an $O_2$ sensor having an output characteristic that the output voltage is apt be biased toward a lean side, the resulting air-fuel ratio is controlled to a richer value than the stoichiometric mixture ratio.

In order to eliminate the deviation of the air-fuel ratio caused by variations of aging changes in the output characteristics of $O_2$ sensors, methods of selecting $O_2$ sensors have been proposed e.g. by Japanese Provisional Patent Publications (Kokai) Nos. 62-93644 and 62-119450, in which respective output characteristics of $O_2$ sensors are checked by means of a special checking device before installing the sensors in vehicles, and based upon the checking results, the sensors are classified into those whose output voltage are apt to be biased toward a rich side and those toward a lean side.

However, the classification or assortment requires such time and labor, resulting in degraded productivity. Meanwhile, if no measures is taken to prevent aging change in the output characteristic of the $O_2$ sensor, the resulting air-fuel ratio will be biased to the lean or rich side, thereby leading to degraded drivability, increased fuel consumption, and deteriorated emission characteristics of the engine.

SUMMARY OF THE INVENTION

It is the object of the invention to provide an air-fuel feedback control method for internal combustion engines, which is capable of automatically correcting, during the feedback control, variations in the output characteristic of the $O_2$ sensor due to manufacturing tolerances and aging change in the output characteristic, thereby enabling to dispense with the classification of assortment of $O_2$ sensors and positively preventing the tendency for the air-fuel ratio to be biased to the lean or rich side.

According to the invention, there is provided a method of controlling the air-fuel ratio of a mixture being supplied to an internal combustion engine having an exhaust system, in a feedback manner responsive to an output signal from sensing means arranged in the exhaust system for sensing the concentration of a component in exhaust gases from the engine to produce as the output signal a normally fluctuating output signal indicative of the concentration of the component, the method including:

comparing the value of the output signal with a predetermined reference value; and controlling the air-fuel ratio of the mixture to a desired value by means of at least one of proportional control applying a first correction value to correct the air-fuel ratio when the output signal changes from a rich side to a lean side or vice versa with respect to the predetermined reference value, and integral control applying a second correction value to correct the air-fuel ratio with a predetermined period so long as the output signal remains on the lean side or on the rich side with respect to the predetermined reference value.

The method according to the invention is characterized by the improvement comprising the steps (1) sensing a rate of change in the value of the output signal;

(2) determining a correcting amount in response to the sensed rate of change; and (3) increasing or decreasing the second correction value by means of the determined correcting amount, depending upon whether the output signal remains on the lean side or on the rich side with respect to the predetermined value.

Preferably, the correcting amount for correcting the second correction value is increased when the output signal from the sensing means changes in a direction away from the predetermined reference value, and at the same time the rate of change sensed is larger than a predetermined value.

The correcting amount for correcting the second correction value is progressively increased, for example, along an exponential curve, as time elapses.

More preferably, the correcting amount for correcting the second correction value is decreased when the output signal from the sensing means changes in a direction toward the predetermined reference value, and at the same time the rate of change sensed is larger than a second predetermined value.

The correcting amount for correcting the second correction value is progressively decreased, for example, along an exponential curve, as time elapses.

The above and other objects, features and advantages of the invention will be more apparent from the ensuing detailed description taken in conjunction with the accompanying drawings.

DETAILED DESCRIPTION

An embodiment of the invention will now be described in detail with reference to the drawings.

Figure 1:
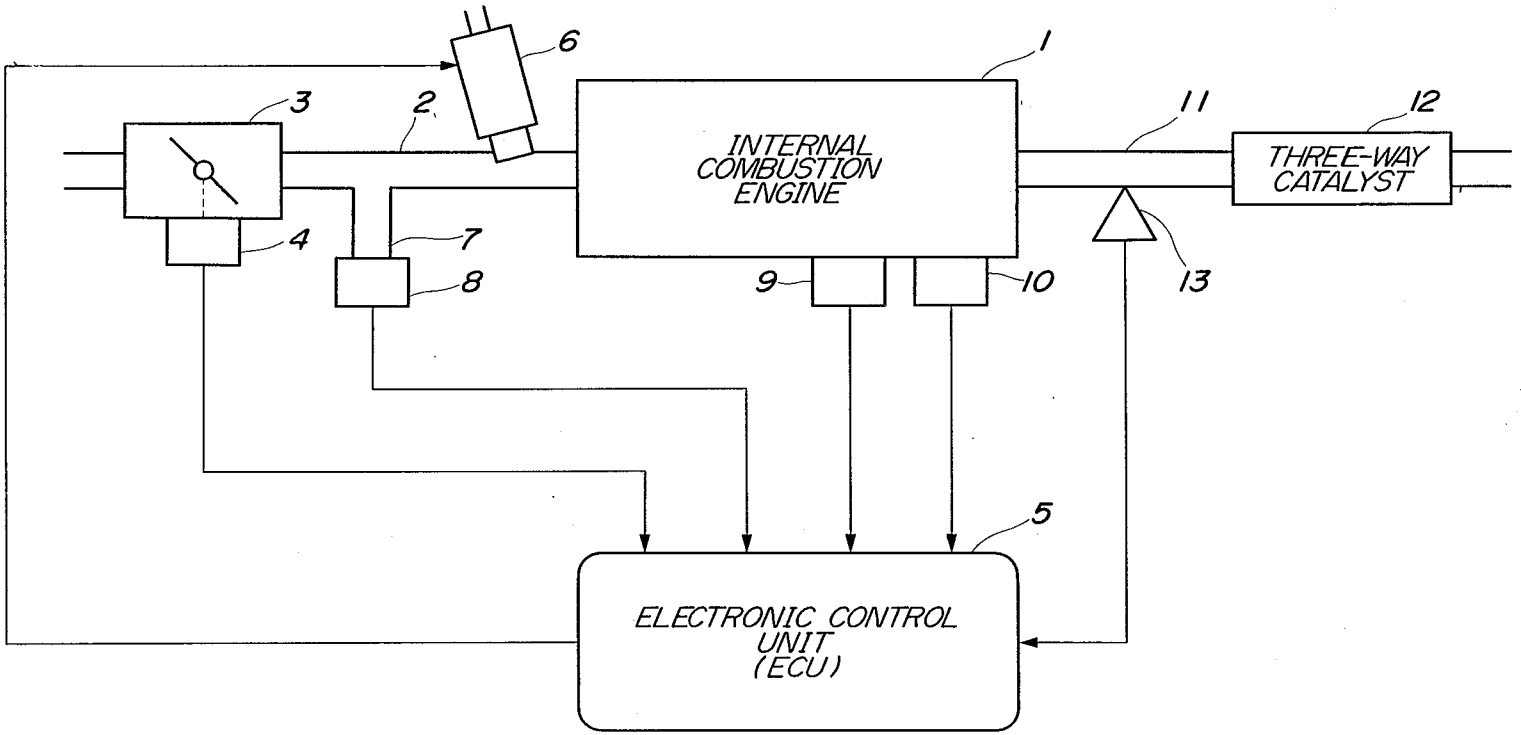
FIG. 1 is a block diagram illustrating the whole arrangement of a fuel supply control system for an internal combustion engine to which is applied the method according to the invention.

Referring first to FIG. 1, there is illustrated the whole arrangement of a fuel supply control system for an internal combustion engine to which is applied the method according to the invention. In the figure, reference numeral 1 designates an internal combustion engine which may be a four-cylinder type for instance, and to which is connected an intake pipe 2 communicating with the atmosphere. A throttle valve 3 is arranged across the intake pipe 2. A throttle valve opening ($\theta$th) sensor 4 is connected to the throttle valve 3 for sensing its valve opening and is electrically connected to an electronic control unit (hereinafter called "the ECU") 5, to supply same with an electrical signal indicative of the throttle valve opening sensed thereby. The ECU 5 calculates desired air-fuel ratios of a mixture to be supplied to the engine and controls the air-fuel ratio to the calculated values, as hereinafter described.

Fuel injection valves 6 are arranged in the intake pipe 2 each at a location slightly upstream of an intake valve, not shown, of a corresponding one of the engine cylinders, not shown, and between the engine 1 and the throttle body 3, for supplying fuel to the corresponding engine cylinder. The fuel injection valves 6 are connected to a fuel pump, not shown, and are electrically connected to the ECU 5, in a manner having their valve opening periods or fuel injection quantities controlled by signals supplied from the ECU 5.

An absolute pressure (PBA) sensor 8 communicates through a conduit 7 with the interior of the intake pipe 2 at a location downstream of the throttle valve 3, to sense absolute pressure in the intake pipe 2 and applies an electrical signal indicative of the detected absolute pressure to the ECU 5.

An engine coolant temperature (TW) sensor 9, which may be formed of a thermistor or the like, is mounted on the cylinder block of the engine 1 in a manner embedded in the peripheral wall of an engine cylinder having its interior filled with coolant, of which an electrical output signal indicative of the sensed coolant temperature is supplied to the ECU 5.

An engine speed (Ne) sensor 10 is arranged on a camshaft, not shown, of the engine 1 or a crankshaft of same, not shown. The Ne sensor 10 is adapted to generate one pulse at one of predetermined crank angles each time the engine crankshaft rotates through 180 degrees, i.e. one pulse of the top-dead-center position (TDC) signal, which is supplied to the ECU 5.

A three-way catalyst 12 is arranged in an exhaust pipe 11 extending from the cylinder block of the engine 1 for purifying components HC, CO and NOx contained in the exhaust gases.

An $O_2$ sensor 13 is inserted in the exhaust pipe 11 at a location upstream of the three-way catalyst 12 for detecting the concentration of oxygen contained in the exhaust gases and supplying an output voltage ($V_{O2}$) indicative of the detected concentration value to the ECU 5.

The ECU 5 operates on the basis of various engine parameter signals inputted thereto from the above-mentioned various sensors to determine engine operating conditions as well as to calculate the valve opening period TOUT of the fuel injection valves 6 in response to the determined engine operating conditions by means of the following equation:

$$TOUT = Ti \times K_1 \times K_{O2} + K_2 \quad (1)$$

where Ti represents a basic value of the fuel injection period for the fuel injection valves 6, and is read from a memory device in the ECU 5 as a function of the engine rotational speed Ne and the intake passage absolute poressure PBA. $K_{O2}$ represents an air-fuel ratio correction coefficient, and is calculated by means of a subroutine, hereinafter described, for calculating the air-fuel ratio correction coefficient. $K_1$ and $K_2$ represent correction coefficients and correction variables having values dependent upon the values of the aformentioned engine parameter signals, and are calculated by the use of predetermined equations, so as to optimize the fuel consumption, accelerability, driveability, emission characteristics, etc. of the engine.

The ECU 5 outputs driving signals for opening the fuel injection valves 6 on the basis of the valve opening period TOUT calculated as above.

Figure 2:
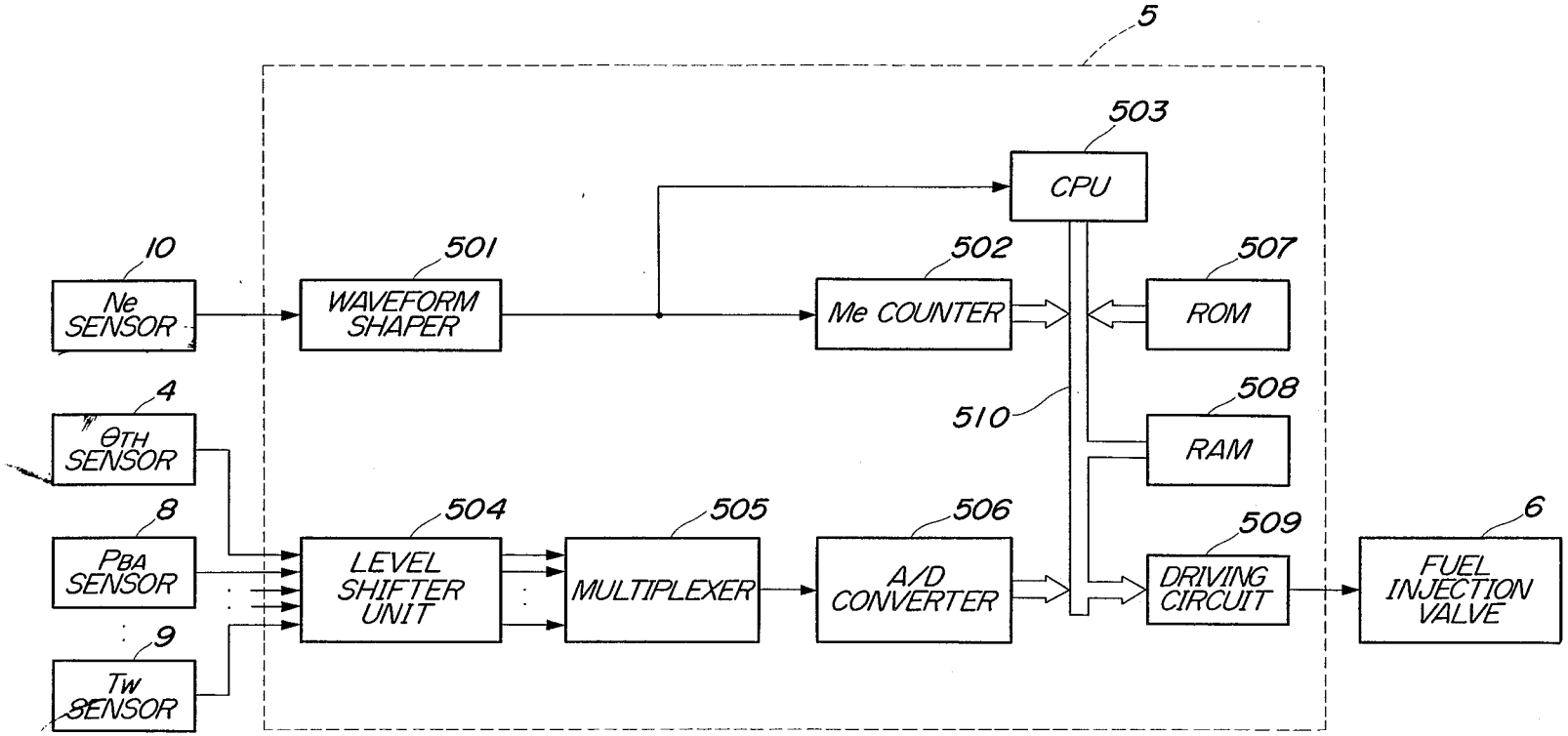
FIG. 2 is a block diagram illustrating the interior arrangement of an electronic control unit (ECU) 5 appearing in FIG. 1.

FIG. 2 shows a circuit configuration within the ECU 5 in FIG. 1. The TDC signal from the Ne sensor 10 in FIG. 1 is applied to a waveform shaper 501, wherein it has its pulse waveform shaped, and the shaped signal is supplied to a central processing unit (hereinafter called "the CPU") 503, as well as to an Me value counter 502. The Me value counter 502 counts the interval of time between a preceding pulse of the TDC signal and a present pulse of the same signal, inputted thereto from the Ne sensor 10. Therefore, its counted value Me corresponds to the reciprocal of the actual engine rotational speed Ne. The Me value counter 202 supplies the counted value Me to the CPU 503 via a data bus 510.

The respective output signals from the throttle valve opening ($\theta$th) sensor 4, the absolute pressure (PBA) sensor 8, the engine coolant temperature (TW) sensor 9, all appearing in FIG. 1, and other sensors are applied to a level shifter unit 504 to have their voltage levels shifted to a predetermined voltage level by the level shifter unit 504 and successively applied to an analog-to-digital converter (A/D converter) 506 through a multiplexer 505 to be operated by a command from the CPU 503. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The ROM 507 stores various control programs to be executed within the CPU 503 as well as data of values of the correction coefficients and data of values of the correction variables etc., while the RAM 508 temporarily stores various calculated values from the CPU 503. The CPU 503 executes a control program stored in the ROM 507 to calculate the fuel injection period TOUT for the fuel injection valves 6 by means of the aforementioned equation (1), in response to the various engine operation parameter signals, and supplies the calculated period value to the driving circuit 509 through the data bus 510. The driving circuit 509 supplies driving signals corresponding to the above calculated TOUT value to the fuel injection valves 6 to drive same.

The air-fuel ratio feedback control method according to the invention will now be described with reference to FIGS. 3 through 9.

Figure 4:
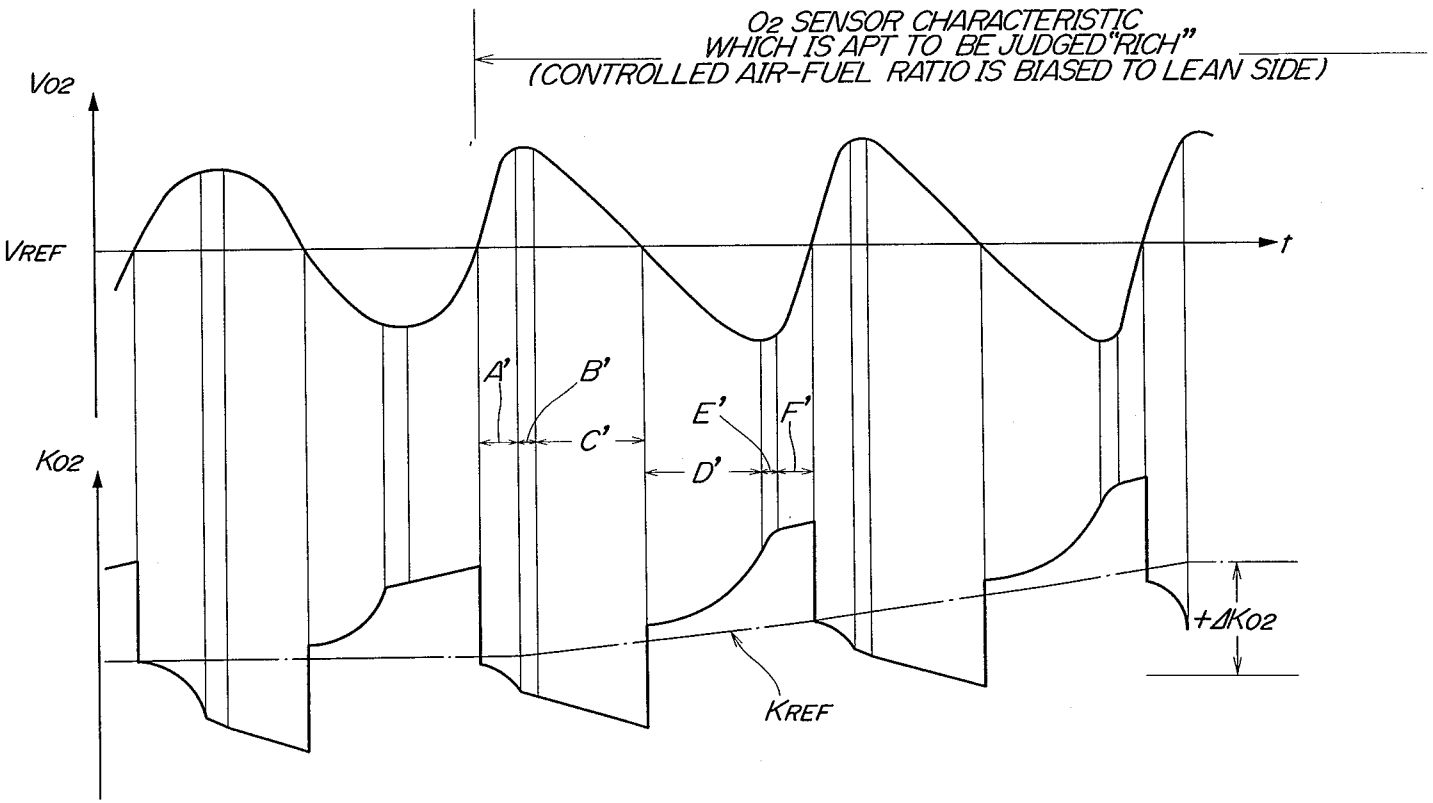
FIG. 4 is a timing chart showing the relationship between the output voltage $V_{O2}$ and the air-fuel ratio correction coefficient $K_{O2}$, plotted with respect to the lapse of time, assumed when the air-fuel ratio feedback control method of the invention is applied to an $O_2$ sensor having an output characteristic that the air-fuel ratio is biased to a lean side.
Figure 5:
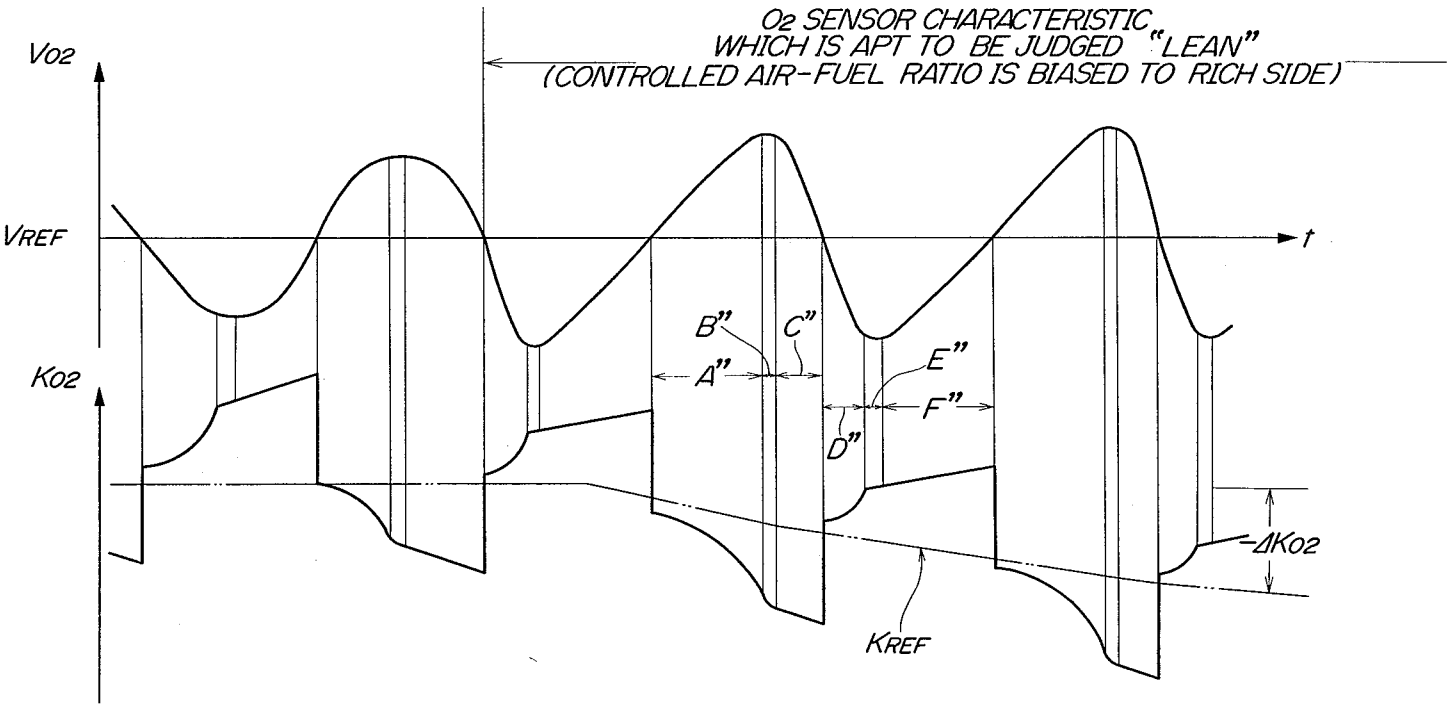
FIG. 5 is a similar timing chart to FIG. 4, assumed when the air-fuel ratio feedback control method of the invention is applied to an $O_2$ sensor having an output characteristic that the air-fuel ratio is biased to a rich side.

As described before $O_2$ sensors in general have variations in the output characteristics due to manufacturing tolerances and aging change. More specifically, the output characteristics of $O_2$ sensors are broadly divided into two types, that is, one type, as shown in FIG. 4, in which the rate of change (i.e. the amount of change per unit time) in output voltage $V_{O2}$ thereof toward a rich side is larger than that toward a lean side. This type tends to judge that the air-fuel ratio is in the rich side with a higher frequency, and the other type, as shown in FIG. 5, in which the rate of change in the output voltage $V_{O2}$ thereof toward a lean side is larger than that toward a rich side. This type tends to judge that the air-fuel ratio is in the lean side with a higher frequency. Therefore, if the feedback control is executed by means of the former type sensor, the resulting air-fuel ratio is biased to the lean side, whereas if the feedback control is executed by means of the latter type sensor, the air-fuel ratio is biased to the rich side.

Figure 3:
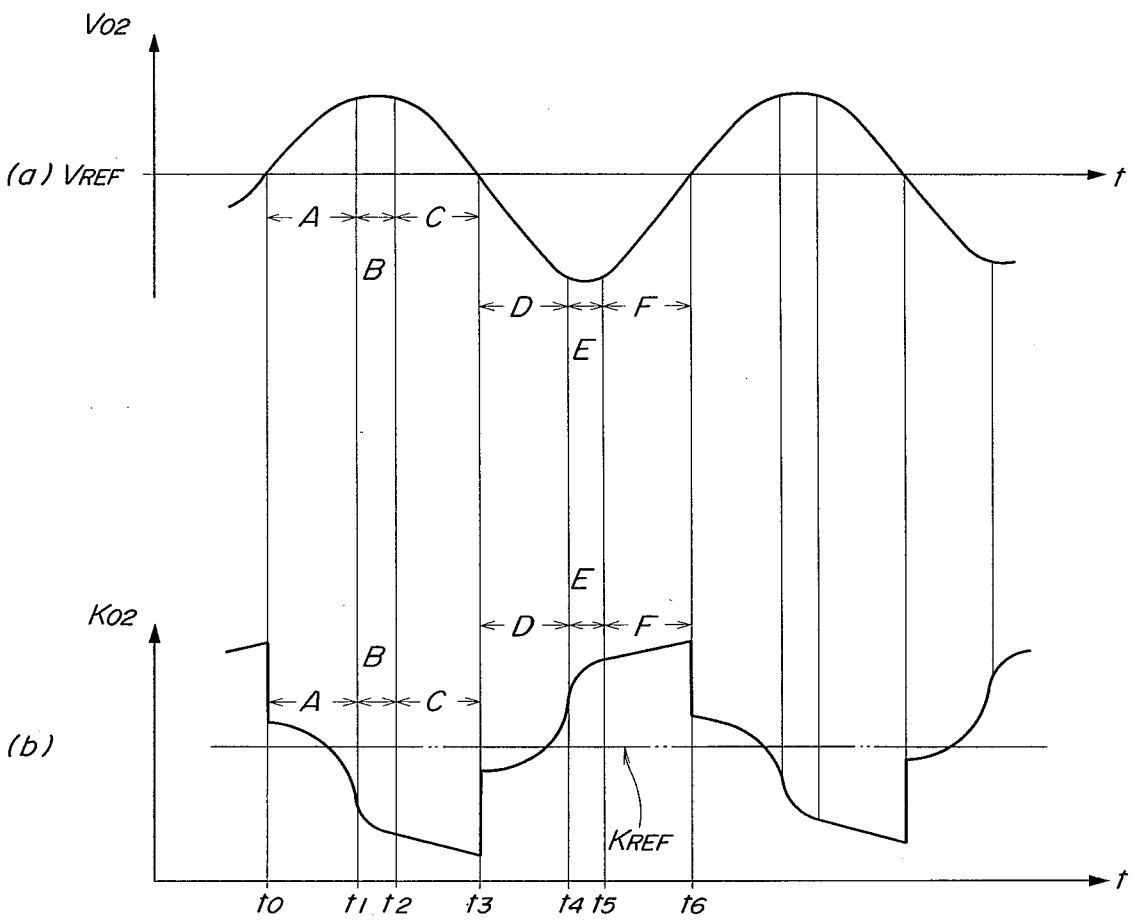
FIG. 3 is a timing chart showing the relationship between the output voltage $V_{O2}$ of an $O_2$ sensor 13 in FIG. 1 and an air-fuel ratio correction coefficient $K_{O2}$, plotted with respect to the lapse of time.

According to the invention, an integral control correction value $I_{Dn}$ is used for correcting the correction coefficient $K_{O2}$ applied to the air-fuel ratio feedback control, in response to the rate of change in the output voltage $V_{O2}$ of the $O_2$ sensor, thereby preventing the air-fuel ratio from being biased to the lean side or to the rich side. According to the embodiment of the invention, as shown in FIG. 3, the integral control correction value $I_{Dn}$ is set as follows in response to the rate of change $\Delta V_{O2}$ in the output voltage $V_{O2}$:

(1) If the output voltage $V_{O2}$ is higher than a predetermined reference value $V_{REF}$ (i.e. if in the rich side), and at the same time the rate of change $\Delta V_{O2}$ is larger than a first predetermined value $D_{VO2H}$ (e.g. + 0.2V), as shown in a region indicated by the symbol A in (a) of FIG. 3, the integral control correction value $I_{Dn}$ is rapidly increased along an exponential curve by multiplying same by a first coefficient $K_{IDH}$ (e.g. 1.6). The rapidly increased integral control correction value $I_{Dn}$ is subtracted from the correction coefficient $K_{O2}$, whenever a TDC signal pulse is generated, thereby rapidly decreasing the correction coefficient $K_{O2}$, as shown at a time period to -t1 in (b) of FIG. 3;

(2) If the output voltage $V_{O2}$ is higher than the predetermined reference value $V_{REF}$ (i.e. if in the rich side), and at the same time the rate of change $\Delta V_{O2}$ is smaller than the first predetermined value $D_{VO2H}$ but larger than a second predetermine value $D_{VO2L}$ (e.g. − 0.2V), as shown in a region indicated by the symbol B in (a) of FIG. 3, the integral control correction value $I_{Dn}$ is decreased by multiplying same by a second coefficient $K_{IDM}$ (e.g. 0.2). The decreased integral control correction value $I_{Dn}$ is subtracted from the correction coefficient $K_{O2}$, thereby gently decreasing the correction coefficient $K_{O2}$, as shown at a time period t1–t2 in (b) of FIG. 3.

(3) If the output voltage $V_{O2}$ is higher than the predetermined reference value $V_{REF}$ (i.e. if in the rich side), and at the same time the rate of change $\Delta V_{O2}$ is smaller than the second predetermined value $D_{VO2L}$, as shown in a region indicated by the symbol C in (a) of FIG. 3, the integral control correction value $I_{Dn}$ is decreased by multiplying same by a third coefficient $K_{IDL}$ (e.g. 0.7). The decreased integral control correction value $I_{Dn}$ is subtracted from the correction coefficient $K_{O2}$, thereby decreasing the correction coefficient $K_{O2}$ more gently than in the region A in (a) of FIG. 3, as shown at a time period t2–t3 in (b) of FIG. 3.

(4) If the output voltage $V_{O2}$ is lower than the predetermined reference value $V_{REF}$ (i.e. if in the lean side), and at the same time the rate of change $\Delta V_{O2}$ is smaller than the second predetermined value $D_{VO2L}$, as shown in a region indicated by the symbol D in (a) of FIG. 3, the integral control correction value $I_{Dn}$ is rapidly increased along an exponential curve by multiplying same by the first coefficient $K_{IDH}$ (e.g. 1.6). The rapidly increased integral control correction value $I_{Dn}$ is added to the correction coefficient $K_{O2}$, thereby rapidly increasing the correction coefficient $K_{O2}$, as shown at a time period t3–t4 in (b) of FIG. 3.

(5) If the output voltage $V_{O2}$ is lower than the predetermined reference value $V_{REF}$ (i.e. if in the lean side), and at the same time the rate of change $\Delta V_{O2}$ is larger than the second predetermined value $D_{VO2L}$ but smaller than the first predetermined value $D_{VO2H}$, as shown in a region indicated by the symbol E in (a) of FIG. 3, the integral control correction value $I_{Dn}$ is decreased by multiplying same by the second coefficient $K_{IDM}$ (e.g. 0.2). The decreased integral control correction value $I_{Dn}$ is added to the correction coefficient $K_{O2}$, as shown at a time period t4–t5 in (b) of FIG. 3.

(6) If the output voltage $V_{O2}$ is lower than the predetermined reference value $V_{REF}$ (i.e. if in the lean side), and at the same time the rate of change $\Delta V_{O2}$ is larger than the first predetermined value $D_{VO2H}$, as shown in a region indicated by the symbol F in (a) of FIG. 3, the integral control correction value $I_{Dn}$ is decreased by multiplying same by the third coefficient $K_{IDL}$ (e.g. 0.7). The decreased integral control correction value $I_{Dn}$ is added to the correction coefficient $K_{O2}$, thereby increasing the correction coefficient $K_{O2}$ more gently than in the region D, as shown at a time period t5–t6 in (b) of FIG. 3.

As described above, since the integral control correction value IDn used for calculating the air-fuel ratio correction coefficient $K_{O2}$ is set in response to the change rate $\Delta V_{O2}$ in the output voltage $V_{O2}$ of the $O_2$ sensor 13, the correction coefficient $K_{O2}$ is rapidly changed when the output voltage $V_{O2}$ changes in a direction away from the predetermined reference value $V_{REF}$, as shown in the regions A and D in (a) and (b) of FIG. 3, while the coefficient $K_{O2}$ is gently changed when the output voltage $V_{O2}$ changes in a direction toward the predetermined reference value $V_{REF}$, as shown in the regions C and F in (a) and (b) of FIG. 3.

Next, a manner of executing the air-fuel ratio feedback control will be described with reference to the flowcharts shown in FIGS. 6 through 9.

Figure 6:
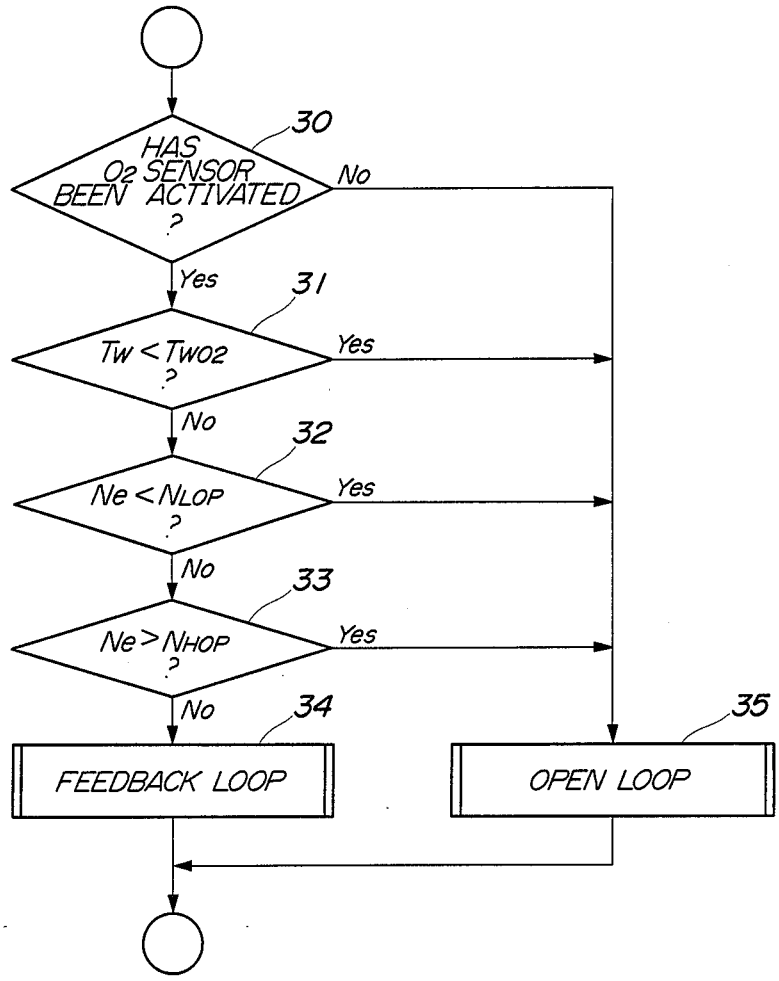
FIG. 6 is a flow chart of a program for determining an engine operating condition in which the air-fuel ratio feedback control to be executed.

FIG. 6 shows a program for determining whether or not the engine is in an operating condition in which the air-fuel ratio feedback control is to be executed.

First, it is determined at a step 30 whether or not the activation of the $O_2$ sensor 13 has been completed. If the answer to the question of the step 30 is No, the program proceeds to a step 35 to set the air-fuel ratio to a desired value by means of open loop control. At this time, the air-fuel ratio correction coefficient $K_{O2}$ is set to an average value $K_{REF}$ of the coefficient $K_{O2}$, hereinafter referred to, or a fixed value (1.0).

On the other hand, if the answer to the question of the step 30 is Yes, that is, if it is determined that the activation of the $O_2$ sensor 13 has been completed, the program proceeds to a step 31 to determine whether or not the engine coolant temperature $T_W$ is lower than a predetermined value $T_{WO2}$ (e.g. 40°). If the answer to the question of the step 31 is Yes, open loop control is effected at the step 35 to quickly warm the engine up, whereas if the answer is No, it is determined whether or not the engine rotational speed Ne is lower than a predetermined rotational speed $N_{LOP}$ (e.g. 600 rpm) at a step 32, followed by determining whether or not the engine rotational speed Ne is higher than a predetermined rotational speed $N_{HOP}$ (e.g. 3000 rpm) at a step 33. If one of the answers to the questions of the steps 32 and 33 is Yes, that is, if it is determined that the engine is in either a predetermined high speed operating condition or a predetermined low speed operating condition, open loop control is effected, whereas if both of the answers are No, the program proceeds to a step 34 to effect the air-fuel ratio feedback control according to the invention, by executing programs shown in FIGS. 7 through 9.

Figures 7, 7A:
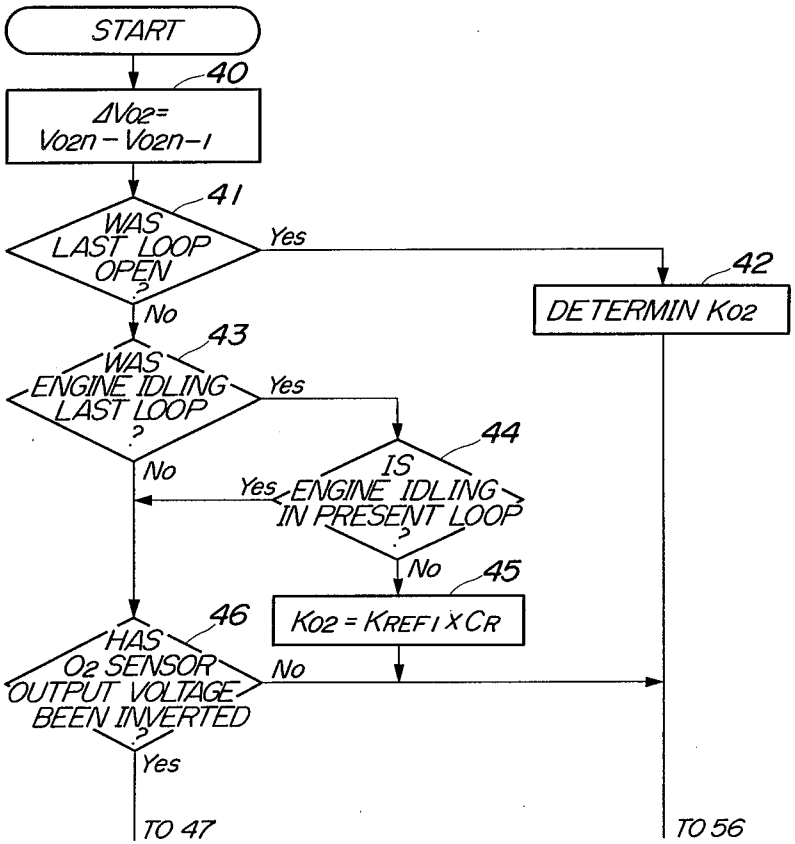
FIGS. 7A and 7B are a flow chart showing a subroutine for calculating the air-fuel ratio correction coefficient $K_{O2}$.
Figure 7B:
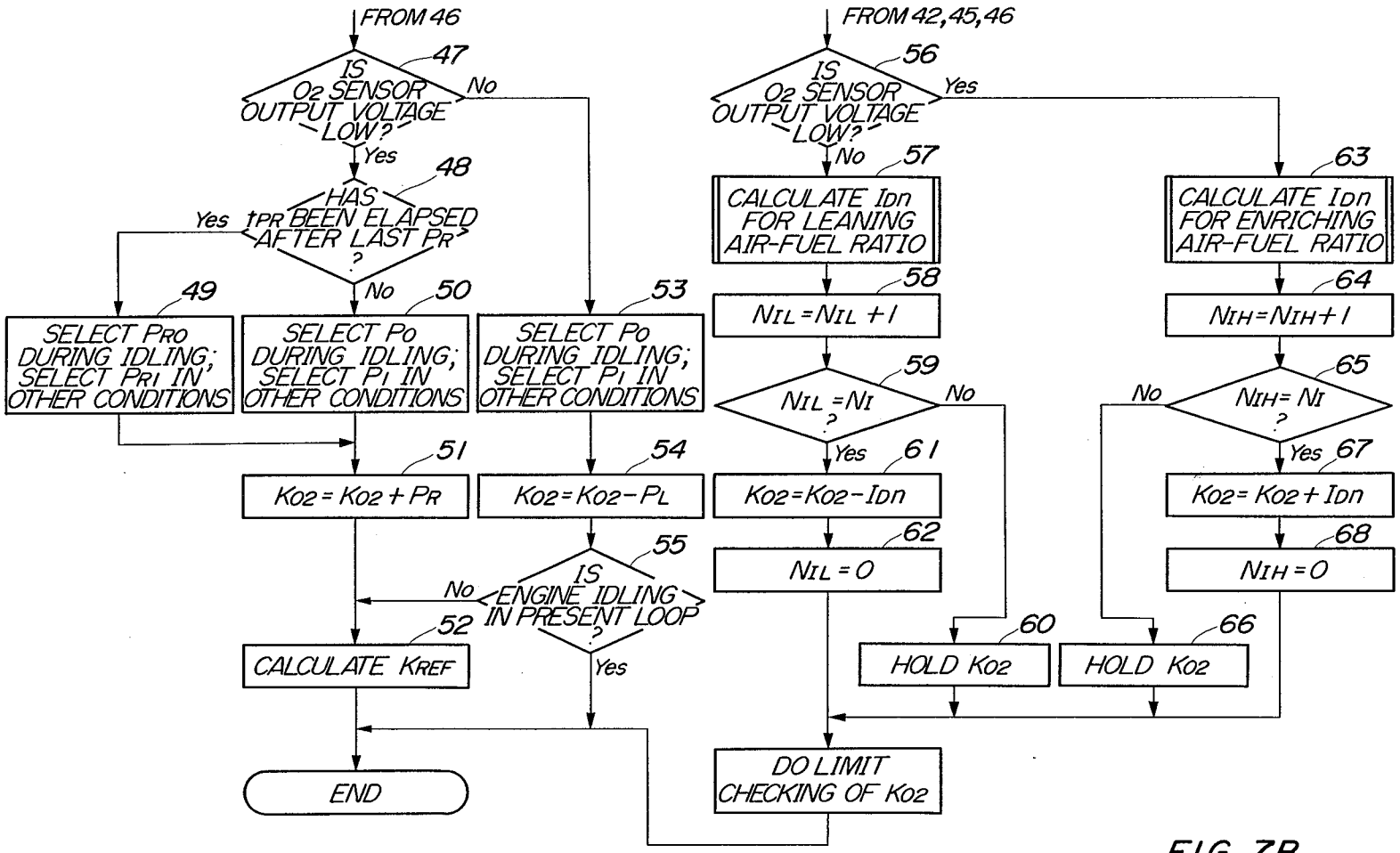

FIG. 7 shows a program for calculating the air-fuel ratio correction coefficient $K_{O2}$ to be carried out at the step 34 in FIG. 6. This program is executed whenefer a pulse of the TDC signal is generated.

First, the rate of change $\Delta V_{O2}$ in the output voltage $V_{O2}$ from the $O_2$ sensor 13 is calculated at a step 40 by subtracting a value $V_{O2n-1}$ of the output voltage in the immediately preceding or last loop from a value $V_{O2n}$ of same in the present loop.

Next, at a step 41, it is determined whether or not open control was executed in the last loop. If the answer to the question of the step 41 is Yes, that is, if it is judged that the feedback control is effected for the first time in the present loop, the program proceeds to a step 42 to determine an initial value of the correction coefficient $K_{O2}$ by executing a $K_{O2}$ initial value setting subroutine, not shown. Then, the program proceeds to a step 56 et seq., hereinafter described, to effect integral control (I-term control) by the use of an integral control correction value $I_{DN}$.

On the other hand, if the answer to the question of the step 41 is No, it is determined whether or not the engine was idling in the last loop at a step 43. If the answer is Yes, the program proceeds to a step 44 to determine whether or not the engine is idling in the present loop. If the answer to the question of the step 44 is No, that is, if it is judged that the the engine has shifted from the idling condition to an off-idling condition, the air-fuel ratio correction coefficient $K_{O2}$ is set at a step 45 to a value which is to be used in the off-idling condition and obtained by multiplying the average value $K_{REF1}$ of the correction coefficient $K_{O2}$ by a predetermined value $C_R$ which is larger than 1.0. The program then proceeds to the step 56 et seq.

If the answer to the question of the step 43 is No, or if both of the answers of the questions of the steps 43 and 44 are Yes, the program proceeds to a step 46 to determine whether or not the output level of the $O_2$ sensor 13 has been inverted. If the answer to the question of the above step is Yes, the program proceeds to a step 47 et seq. to effect proportional control (P-term control), whereas if the answer is No, the program proceeds to the step 56 et seq. to effect the integral control (I-term control).

If the answer to the question of the step 46 is Yes, that is, if the output level of the $O_2$ sensor 13 has been inverted, it is determined at the step 47 whether or not the output level of same is at a low level (LOW). If the answer is Yes, it is determined at a step 48 whether or not a predetermined period of time $t_{PR}$ has elapsed since a proportional control correction value $P_R$ was applied last time. The predetermined time period $t_{PR}$ is determined based upon the engine rotational speed Ne by using an Ne-$t_{PR}$ table, not shown, and is used to maintain constant the cycle of applying the proportional control correction value $P_R$ over the entire engine rotational range.

If the answer to the question of the step 48 is Yes, the proportional control correction value $P_R$ is set to a value $P_{RO}$ when the engine is in the idling condition, whereas it is set to a value $P_{R1}$ when the engine is not in the idling condition, at a step 49. On the other hand, if the answer to the question of the step 48 is No, the proportional control correction value $P_R$ is set to a value $P_O$ when the engine is in the idling condition, whereas it is set to a value $P_1$ when the engine is not in the idling condition, at a step 50. The proportional control correction value $P_R$ selected as above is added to the correction coefficient $K_{O2}$ at a step 51. The thus increased coefficient $K_{O2}$ is also used for calculation of the average value $K_{REF}$ of the $K_{O2}$ at a step 52, followed by terminating the program.

If the answer to the question of the step 47 is No, that is, if the output level of the $O_2$ sensor 13 is at a high level (HIGH), the proportional control correction value $P_L$ is set to a value $P_O$ when the engine is in the idling condition, whereas it is set to a value $P_1$ when the engine is not in the idling condition, at a step 53. The program then proceeds to a step 54 to subtract the resulting proportional control correction value $P_L$ from the correction coefficient $K_{O2}$. At a next step 55, it is again determined whether or not the engine is in the idling condition in the present loop. If the answer to the question of the step 55 is No, the program proceeds to the step 52 to apply the correction coefficient $K_{O2}$ obtained at the step 54 to calculate the average value $K_{REF}$ of the $K_{O2}$, whereas if the answer is Yes, the program skips the step 52 to be terminated.

If the answer to the question of the step 41 is Yes, or if the answer to the question of the step 44 is No, or if the answer to the question of the step 46 is No, the integral control (I-term control) is effected. First, at the step 56, it is determined whether or not the output level of the $O_2$ sensor 13 is Low. If the answer to the question of the step 56 is No, the integral control correction value is set at a step 57 by executing a subroutine for determining the integral control correction value ($I_{Dn}$) for leaning the air-fuel ratio, hereinafter described with reference to FIG. 8. Then the program proceeds to a step 58 to count the number $N_{IL}$ of pulses of the TDC signals, and at a next step 59 it is determined whether or not the number $N_{IL}$ of the counted pulses has reached a predetermined value $N_I$. If the answer to the question of the step 59 is No, the correction coefficient $K_{O2}$ is held at the last value, at a step 60, whereas if the answer is Yes, the enriching integral control correction value $I_{Dn}$ obtained at the step 57 is subtracted from the correction coefficient $K_{O2}$ at a step 61, and at the same time the counted value $N_{IL}$ is reset to zero at a step 62. In this manner, whenever the counted value $N_{IL}$ reaches $N_I$, the leaning integral control correction value $I_{Dn}$ is subtracted from the correction coefficient $K_{O2}$.

If the answer to the question of the step 56 is Yes, the integral control correction value is set at a step 63 by executing a subroutine for determining the integral control correction value $I_{Dn}$ for enriching the air-fuel ratio, hereinafter described with reference to FIG. 9. Then the program proceeds to a step 64 to count the number $N_{IH}$ of pulses of the TDC signals, and at a next step 65 it is determined whether or not the number $N_{IH}$ of the counted pulses has reached a predetermined value $N_I$. If the answer to the question of the step 65 is No, the correction coefficient $K_{O2}$ is held at the last value, at a step 66, whereas if the answer is Yes, the enriching integral control correction value $I_{Dn}$ obtained at the step 63 is added to the correction coefficient $K_{O2}$ at a step 67, and at the same time the counted value $N_{IH}$ is reset to zero at a step 68. In this manner, whenever the counted value $N_{IH}$ reaches the predetermined value $N_I$, the leaning integral control correction value $I_{Dn}$ is added to the correction coefficient $K_{O2}$.

In the manner described above, so far as the output level of the $O_2$ sensor 13 is maintained at the lean or rich level, the integral control coefficient $I_{Dn}$, determined in response to the rate of change $\Delta V_{O2}$ in the output voltage $V_{O2}$ of the $O_2$ sensor 13, is added to or subtracted from the correction coefficient $K_{O2}$ at the step 57 or 63 in such a direction as to correct the value $K_{O2}$ so as to obtain a desired air-fuel ratio, whenever the number of the counted pulses of the TDC signal inputted reaches the predetermined value $N_I$.

The air-fuel ratio correction coefficient $K_{O2}$ thus corrected by the integral control correction value $I_{Dn}$ is subjected to limit checking at a step 69 to be set to the maximum or minimum allowable value if the correction coefficient $K_{O2}$ exceeds the latter, followed by termination of the program.

A manner of determining the integral control correction value $I_{Dn}$ calculated at steps 57 and 63 in FIG. 7 will now be described with reference to FIGS. 8 and 9.

Figure 8:
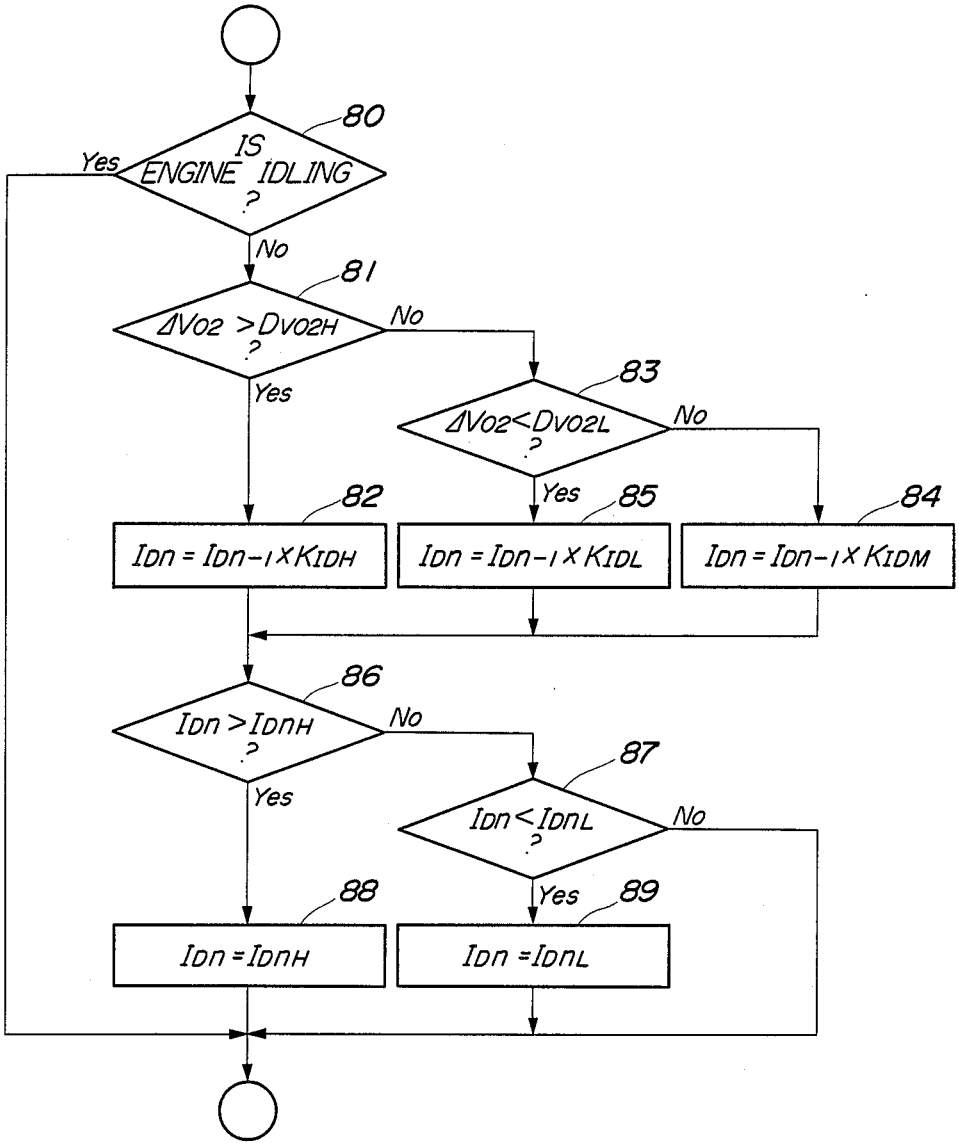
FIG. 8 is a flow chart showing a subroutine for determining an integral control correction value for leaning the air-fuel ration, according to the invention.

FIG. 8 shows a subroutine for determining the integral control correction value ($I_{Dn}$) for leaning the air-fuel ratio, which is to be executed if the output voltage $V_{O2}$ of the $O_2$ sensor 13 is High. This subroutine is executed whenever a pulse of the TDC signal is generated.

At a step 80, it is determined whether or not the engine is in the idling condition. If the answer to the question of the step 80 is Yes, the program skips over steps 81 through 89 to be terminated, in order to avoid a change in the air-fuel ratio during the idling condition, due to a change in the correction value $I_{Dn}$. On the other hand, if the answer to the question of the step 80 is No, it is determined at a step 81 whether or not the change rate $\Delta V_{O2}$ between a value of the output voltage $V_{O2}$ of the $O_2$ sensor 13 at an immediately preceding pulse of the TDC signal and that at the present pulse, which change rate has been calculated at the step 40 in FIG. 7, is larger than the first predetermined value $D_{VO2H}$. If the answer to the question of the step 81 is Yes, that is, if the output voltage $V_{O2}$ of the $O_2$ sensor 13 is increasing in a direction away from the predetermined reference value $V_{REF}$ i.e. to a richer value, as shown in the region A in (a) of FIG. 3, the program proceeds to the next step 82 to set the integral control correction value $I_{Dn}$ in the present loop by multiplying the integral control correction value $I_{Dn-1}$ obtained in the last loop by the first coefficient $K_{IDH}$ (e.g. 1.6). Therefore, as the step 82 is repeatedly executed, the integral control correction value $I_{Dn}$ is exponentially progressively increased.

If the answer to the question of the step 81 is No, the program proceeds to a step 83 to determine whether or not the change rate $\Delta V_{O2}$ in the output voltage is smaller than the second predetermined value $D_{VO2L}$. If the answer to the question of the step 83 is No, that is, if the output voltage $V_{O2}$ of the $O_2$ sensor 13 is in a transitional region where it turns from the increasing direction to the decreasing direction, as shown in the region B in (a) of FIG. 3, the program proceeds to a step 84 to set the integral control correction value $I_{Dn}$ in the present loop by multiplying the integral control correction value $I_{Dn-1}$ (which is relatively large at this time) obtained in the last loop by the second coefficient $K_{IDM}$ (e.g. 0.2). If the answer to the question of the step 83 is Yes, that is, if the output voltage $V_{O2}$ of the $O_2$ sensor 13 is decreasing toward the predetermined reference value $V_{REF}$, as shown in the region C in (a) of FIG. 3, the program proceeds to a step 85 to set the integral control correction value $I_{Dn}$ in the present loop by multiplying the integral control correction value $I_{Dn-1}$ obtained in the last loop by the third coefficient $K_{IDL}$ (e.g. 0.7).

The integral control correction value $I_{Dn}$, thus set in response to the change rate $\Delta V_{O2}$ in the output voltage of the $O_2$ sensor 13, is subjected to limit checking. That is, it is determined whether or not it is larger than an upper limit value $I_{DnH}$ (step 86) and whether or not it is smaller than a lower limit value $I_{DnL}$ (step 87). If the answer to the question of the step 86 is Yes, the correction value $I_{Dn}$ is set to the upper limit value $I_{DnH}$ at a step 88, while if the answer to the question of the step 87 is Yes, the correction value $I_{Dn}$ is set to the lower limit value $I_{DnL}$ at a step 89.

Figure 9:
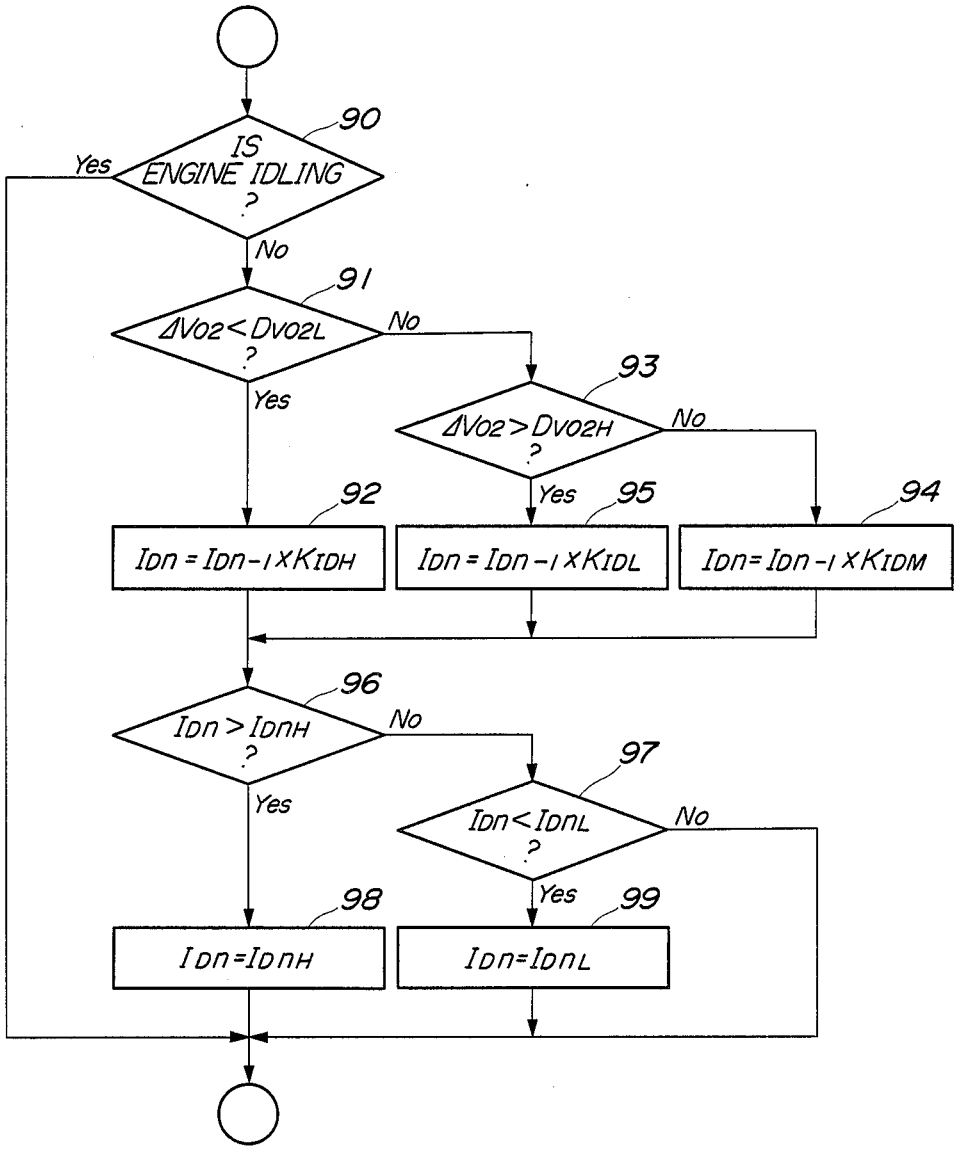
FIG. 9 is a flow chart showing a subroutine for determining an integral control correction value for enriching the air-fuel ratio, according to the invention.

FIG. 9 shows a subroutine for determining the integral control correction value ($I_{Dn}$) for enriching the air-fuel ratio, which is to be executed if the output voltage $V_{O2}$ of the $O_2$ sensor 13 is LOW. This subroutine is executed whenever a pulse of the TDC signal is generated.

At a step 90, it is determined whether or not the engine is in the idling condition. If the answer to the question of the step 90 is Yes, the program skips over steps 91 through 99 to be terminated. On the other hand, if the answer to the question of the step 90 is No, it is determined at a step 91 whether or not the change rate $\Delta V_{O2}$ in the output voltage $V_{O2}$ of the $O_2$ sensor 13 is smaller than the second predetermined value $D_{VO2L}$. If the answer to the question of the step 91 is Yes, that is, if the output voltage $V_{O2}$ of the $O_2$ sensor 13 is decreasing in a direction away from the predetermined reference value $V_{REF}$ i.e. to a leaner value, as shown in the region D in (a) of FIG. 3, the program proceeds to the next step 92 to set the integral control correction value $I_{Dn}$ in the present loop by multiplying the integral control correction value $I_{Dn-1}$ obtained in the last loop by the first coefficient $K_{IDH}$ (e.g. 1.6), similarly to the above-described step 82. Therefore, as the step 92 is repeatedly executed, the integral control correction value $I_{Dn}$ is exponentially progressively increased.

If the answer to the question of the step 91 is No, the program proceeds to a step 93 to determine whether or not the change rate $\Delta V_{O2}$ in the output voltage is larger than the first predetermined value $D_{VO2H}$. If the answer to the question of the step 93 is No, that is, if the output voltage $V_{O2}$ of the $O_2$ sensor 13 is in a transitional region where it turns from the decreasing direction to the increasing direction, as shown in the region E in (a) of FIG. 3, the program proceeds to a step 94 to set the integral control correction value $I_{Dn}$ in the present loop by multiplying the integral control correction value $I_{Dn-1}$ (which is relatively large at this time) obtained in the last loop by the second coefficient $K_{IDM}$ (e.g. 0.2). If the answer to the question of the step 93 is Yes, that is, if the output voltage $V_{O2}$ of the $O_2$ sensor 13 is increasing toward the predetermined reference value $V_{REF}$, as shown in the region F in (a) of FIG. 3, the program proceeds to a step 95 to set the integral control correction value $I_{Dn}$ in the present loop by multiplying the integral control correction value $I_{Dn-1}$ obtained in the last loop by the third coefficient $K_{IDL}$ (e.g. 0.7).

The integral control correction value $I_{Dn}$, thus set in response to the change rate $\Delta V_{O2}$ in the output voltage of the $O_2$ sensor 13, is subjected to limit checking to be compared with the upper and lower limits $I_{DnH}$ and $I_{DnL}$, at the following steps 96 through 99, similarly to the steps 86 through 89 in FIG. 8.

Reference is now made to results produced by the air-fuel ratio feedback control method according to the invention.

As described above, according to the invention, the integral control correction value $I_{Dn}$ is set in response to the change rate $\Delta V_{O2}$ in the output voltage $V_{O2}$ of the $O_2$ sensor 13. More specifically, the integral control correction value $I_{Dn}$ is progressively increased in response to the change rate $\Delta V_{O2}$ when it is judged that the output voltage $V_{O2}$ is changing in the direction away from the predetermined reference value $V_{REF}$, whereas it is progressively decreased in response to the change rate $\Delta V_{O2}$ when it is judged that the output voltage $V_{O2}$ is changing in the direction toward the predetermined reference value $V_{REF}$. In this way, the air-fuel ratio correction coefficient $K_{O2}$ is corrected at a rate corresponding to the change rate $\Delta V_{O2}$ in the output voltage $V_{O2}$.

It is generally known that the air-fuel ratio tends to be biased to the lean side if the conventional air-fuel ratio feedback control is executed by using such an $O_2$ sensor as has an output characteristic as shown in FIG. 4, i.e. the output voltage $V_{O2}$ quickly changes to the rich side (i.e. the air-fuel ratio is quickly judged to be rich), while it slowly changes to the lean side (i.e. the air-fuel ratio is slowly judged to be lean).

If the air-fuel feedback control of the present invention is applied to an engine provided with an $O_2$ sensor having the output characteristic of FIG. 4, the following results can be obtained, as shown in FIG. 4:

1. In a region A′ corresponding to the region A in FIG. 3, the integral control correction value $I_{Dn}$ is exponentially progressively increased (by being multiplied by a value larger than 1.0, e.g. 1.6, whenever a pulse of TDC signal is generated), while in a region C′ corresponding to the region C in FIG. 3, the integral control correction value $I_{Dn}$ is exponentially progressively decreased (by being multiplied by a value smaller than 1.0, e.g. 0.7, whenever a pulse of the TDC signal is generated).

2. In a region D′ corresponding to the region D in FIG. 3, the integral control correction value $I_{Dn}$ is exponentially progressively increased (by being multiplied by a value larger than 1.0, e.g. 1.6, whenever a pulse of the TDC signal is generated), while in a region F′ corresponding to the region F in FIG. 3, the integral control correction value $I_{Dn}$ is exponentially progressively decreased (by being multiplied by a value smaller than 1.0, e.g. 0.7, whenever a pulse of the TDC signal is generated).

The time periods A′, C′, D′, and F′ in FIG. 4 satisfy the relationships of $A' < C'$, and $D' > F'$, and usually $A' < D'$, and $C' > F'$. Therefore, the correction coefficient KO2 has a larger rate of change toward the rich side than toward the lean side.

As a result, if the air-fuel feedback control of the invention is applied to an $O_2$ sensor having the output characteristic shown in FIG. 4, which is liable to judge the air-fuel ratio to be rich, so that the resulting air-fuel ratio is liable to be biased to the lean side, the air-fuel ratio is automatically corrected to the rich side by an amount $+\Delta K_{O2}$, as shown in FIG. 4, thereby controlling the air-fuel ratio to a desired ratio, e.g. the stoichiometric mixture ratio.

On the other hand, it is also generally known that the air-fuel ratio tends to be biased to the rich side if the conventional air-fuel ratio feedback control is executed by using such an $O_2$ sensor as has an output characteristic as shown in FIG. 5, i.e. the output voltage $V_{O2}$ quickly changes to the lean side (i.e. the air-fuel ratio is quickly judged to be lean), while it slowly changes to the rich side (i.e. the air-fuel ratio is slowly judged to be rich).

If the air-fuel feedback control of the invention is applied to an engine provided with an $O_2$ sensor having the output characteristic of FIG. 5, the following results can be obtained, as shown in FIG. 5:

1. In a region A″ corresponding to the region A in FIG. 3, the integral control correction value $I_{Dn}$ is exponentially progressively increased (by being multiplied by a value larger than 1.0, e.g. 1.6, whenever a pulse of the TDC signal is generated), while in a region C″ corresponding to the region C in FIG. 3, the integral control correction value $I_{Dn}$ is exponentially progressively decreased (by being multiplied by a value smaller than 1.0, e.g. 0.7, whenever a pulse of the TDC signal is generated). Therefore, a ratio of change in the correction coefficient $K_{O2}$ to the lean side is increased.

2. In a region D″ corresponding to the region D in FIG. 3, the integral control correction value $I_{Dn}$ is exponentially progressively increased (by being multiplied by a value larger than 1.0, e.g. 1.6, whenever a pulse of the TDC signal is generated), while in a region F″ corresponding to the region F in FIG. 3, the integral control correction value $I_{Dn}$ is exponentially progressively decreased (by being multiplied by a value smaller than 1.0, e.g. 0.7, whenever a pulse of the TDC signal is generated).

The time periods A'', C'', D'', and F'' in FIG. 5 satisfy the relationships of A'' > C'', and D'' < F'', and usually A'' > D'' < and C'' < F''. Therefore, the correction coefficient $K_{O2}$ has a larger rate of change toward the lean side than toward the rich side.

As a result, if the air-fuel feedback control of the invention is applied to an $O_2$ sensor having the output characteristic shown in FIG. 5, which is liable to judge the air-fuel ratio to be lean so that the resulting air-fuel ratio is liable to be biased to the rich side, the air-fuel ratio is automatically corrected to the lean side by an amount $-\Delta K_{O2}$, as shown in FIG. 5, thereby controlling the air-fuel ratio to the desired ratio.

In the manner described above, the integral control correction value $I_{Dn}$ is set to different values in response to waveforms (output characteristics) of the output voltage $V_{O2}$ of the $O_2$ sensor 13 by means of the program within the ECU 5, thereby enabling to automatically compensate for variations in the output characteristics of $O_2$ sensors 13 caused by manufacturing tolerance and aging.

Therefore, according to the invention, regardless of the output characteristics of the O2 sensors employed, the air-fuel ratio can be controlled to the desired ratio, thereby enhancing the conversion efficiency of the three way catalyst.

Although in the embodiment described above the integral control correction value $I_{Dn}$ is increased or decreased in an exdponentially progressive manner in response to the rate of change of the $O_2$ sensor output, this is not limitative to the invention, but alternatively the value $I_{Dn}$ may be linearly increased or decreased with a gradient corresponding to the rate of change of the $O_2$ sensor output.

What is claimed is:

1. In a method of controlling the air-fuel ratio of a mixture being supplied to an internal combustion engine having an exhaust system, in a feedback manner responsive to an output signal from sensing means arranged in said exhaust system for sensing the concentration of a component in exhaust gases from said engine to produce as said output signal a normally fluctuating output signal indicative of the concentration of said component, the method including:

comparing the value of said output signal with a predetermined reference value; and controlling the air-fuel ratio of said mixture to a desired value by means of at least one of proportional control applying a first correction value to correct the air-fuel ratio when said output signal changes from a rich side to a lean side or vice versa with respect to said predetermined reference value, and integral control applying a second correction value to correct the air-fuel ratio with a predetermined period so long as said output signal remains on the lean side or on the rich side with respect to said predetermined reference value, the improvement comprising the steps of:

(1) sensing a rate of change in the value of said output signal;

(2) determining a correcting amount in response to the sensed rate of change; and (3) increasing or decreasing said second correction value by means of said determined correcting amount, depending upon whether said output signal remains on the lean side or on the rich side with respect to said predetermined value.

2. A method as claimed in claim 1, wherein said correcting amount for correcting said second correction value is increased when said output signal from said sensing means changes in a direction away from said predetermined reference value, and at the same time the rate of change sensed is larger than a predetermined value.

3. A method as claimed in claim 2, wherein said correcting amount for correcting said second correction value is progressively increased as time elapses.

4. A method as claimed in claim 3, wherein said correcting amount for correcting said second correction value is exponentially progressively increased as time elapses.

5. A method as claimed in any of claims 1–4, wherein said correcting amount for correcting said second correction value is decreased when said output signal from said sensing means changes in a direction toward said predetermined reference value, and at the same time the rate of change sensed is larger than a second predetermined value.

6. A method as claimed in claim 5, wherein said correcting amount for correcting said second correction value is progressively decreased as time elapses.

7. A method as claimed in claim 6, wherein said correcting amount for correcting said second correction value is exponentially progressively decreased as time elapses.

8. A method as claimed in claim 5, wherein when the rate of change is said output signal is smaller than said first-mentioned predetermined value, said correcting amount for correcting said second correction value is progressively decreased at a larger rate than when the rate of change of same is larger than said second predetermined value.

9. A method as claimed in claim 5, wherein when the rate of change in said output signal is smaller than said second predetermined value, said correcting amount for correcting said second correction value is progressively decreased at a larger rate than when the rate of change of same is larger than said second predetermined value.

10. A method as claimed in claim 1, wherein said first and second correction values correct a correction coefficient for correcting a basic control value for controlling the air-fuel ratio.

* * * * *